US005401387A

United States Patent [19]

Harandi et al.

[11] Patent Number: 5,401,387

[45] Date of Patent: Mar. 28, 1995

[54] CATALYTIC CRACKING IN TWO STAGES

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 101,810

[22] Filed: Aug. 3, 1993

Related U.S. Application Data

[63] Continuation of Ser. No. 807,005, Dec. 13, 1991, abandoned.

[51] Int. Cl.[6] ..... C10G 51/02

[52] U.S. Cl. ..... 208/74; 208/76; 208/78

[58] Field of Search ..... 208/74, 76, 78

[56] References Cited

U.S. PATENT DOCUMENTS

| | | | |
|---|---|---|---|
| 3,803,024 | 9/1974 | Haunschild | 208/74 |
| 3,928,172 | 12/1975 | Davis, Jr. et al. | 208/78 |
| 4,234,411 | 11/1980 | Thompson | 208/74 |
| 4,436,613 | 3/1984 | Sayles et al. | 208/74 |
| 4,492,624 | 1/1985 | Johnson et al. | 208/78 |
| 4,591,425 | 5/1986 | Kovach et al. | 208/74 |
| 4,606,810 | 8/1986 | Krambeck et al. | 208/74 |
| 4,784,745 | 11/1988 | Nace | 208/74 |
| 4,830,728 | 5/1989 | Herbst et al. | 208/74 |
| 4,863,585 | 9/1989 | Herbst et al. | 208/74 |
| 4,892,643 | 1/1990 | Herbst et al. | 208/74 |
| 4,927,522 | 5/1990 | Herbst et al. | 208/120 |
| 4,944,862 | 7/1990 | Chen et al. | 208/49 |
| 4,990,712 | 5/1990 | Harandi et al. | 585/324 |
| 4,994,170 | 2/1991 | Lipinski et al. | 208/59 |

*Primary Examiner*—Helane Myers

*Attorney, Agent, or Firm*—Alexander J. McKillop; Malcolm D. Keen; Richard D. Stone

[57] ABSTRACT

A process for multi-stage catalytic cracking is disclosed. A first stage cracks a first feed at atmospheric to 100 psig over a shape selective zeolite to convert from 10 to 90%, by volume, to lighter products rich in iso-compounds which may be used to make ethers. A second feed, which may include 700° F.+ liquid from the selective cracking reaction, is cracked in a catalytic cracking (FCC) unit. Preferably all or some of the products from the shape selective cracking reactor are fractionated in the FCC main column.

15 Claims, 1 Drawing Sheet

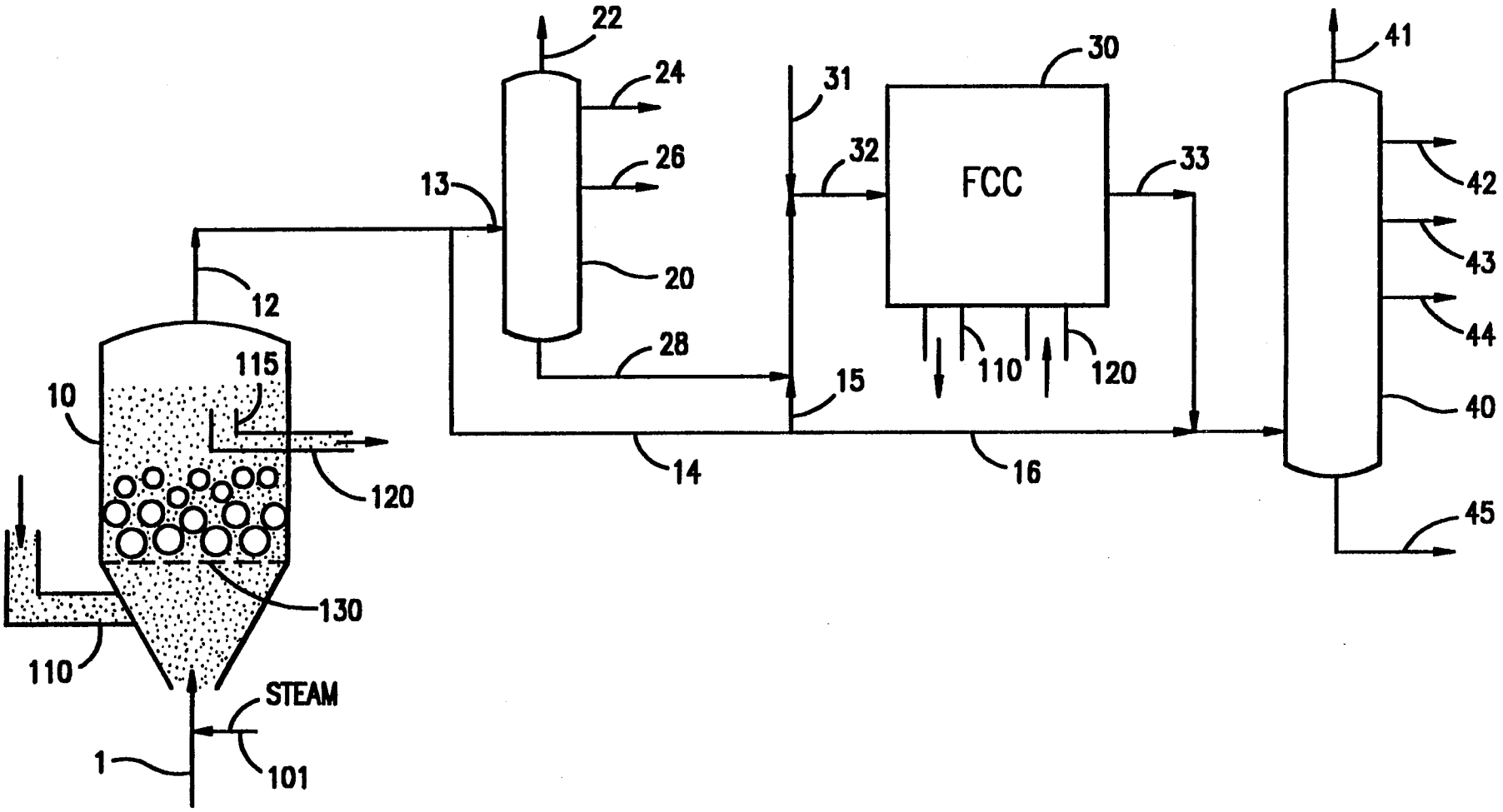
FCC
STEAM
1
10
12
13
14
15
16
20
22
24
26
28
30
31
32
33
40
41
42
43
44
45
101
110
115
120
130

CATALYTIC CRACKING IN TWO STAGES

This is a continuation of copending application Ser. No. 07/807,005, filed on Dec. 13, 1991, now abandoned.

BACKGROUND OF THE INVENTION

1. Field of the Invention

The field of the invention is catalytic cracking of heavy hydrocarbon feeds to lighter products.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425°-600° C., usually 460°-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 600°-900° C., usually 600°-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Riser cracking gives higher yields of valuable products than dense bed cracking. Most FCC units now use all riser cracking, with hydrocarbon residence times in the riser of less than 10 seconds, and even less than 5 seconds.

The product distribution from modern FCC units is very good, in that the amount and octane number of the gasoline product is very satisfactory, and the light ends are readily upgraded in sulfuric or HF alkylation units to produce high quality alkylate. Unfortunately, refiners are finding it more and more difficult to make enough gasoline of sufficient octane while also meeting new specifications in regards to the amount of oxygenates, aromatics and benzene in the fuel. Reduced limits on RVP (Reid Vapor Pressure) and gasoline end point reduce the amount of butanes that can be added, further exacerbating the problem.

We wanted to develop a way to squeeze more gasoline and distillate out of FCC processing, and also to change the quality and quantity of the light ends made by the FCC process. We wanted more iso- compounds, which have a higher octane number and which are also more reactive in other processing units, e.g., etherification and alkylation. We wanted to produce a higher quality distillate product (LCO) containing less aromatics. We wanted to reduce the FCC process light gas make, to minimize the capital and operating expense of the FCC light gas processing equipment. We wanted to reduce overall process coke make and catalyst circulation rates which bottleneck many existing FCC unit operations. We also wanted to provide way to reduce the FCC regenerator emissions, including particulate and CO/CO2 emissions.

The way conventional FCC processes operate, we were severely limited. The trend in modern FCC units is to higher riser temperatures, and shorter contact times in the riser reactor and heavier feeds and extremely high conversions. These conditions increase olefin yields, but the higher temperatures associated with such operation reduce the production of iso-olefins and iso-paraffins, while increasing the undesired production of coke and light ends.

We realized that conventional FCC processing had generally been optimized in regards to conversion of "the bottom of the barrel", with constant pushing of the unit to tolerate ever heavier feedstocks. This approach yielded considerable success, and enabled many FCC units to process feeds containing 5 to 10 wt % of non-distillable or residual feedstock. While processing of heavy feeds usually produced a gasoline fraction of reasonably high octane content, and produced a reasonably large amount of olefins, there was relatively low production of iso- compounds. Thus FCC units were evolving to process heavier feeds, of worse quality, but in so doing were also making it harder to efficiently produce clean fuels for gasoline engines.

We decided to take a different approach. We realized that two stage processing of FCC feeds was necessary to get a breakthrough in iso-component yields, but an entirely different kind of two stage processing than had heretofore been used.

Two stages processing of hydrocarbon feeds in FCC is common for heavy feeds, those containing large amounts of non-distillables and metals. Several processes have been developed in which a fluidized first stage of processing removes much of the metals and non-distillables from the feed, to produced a demetallized product. The demetallized product is then processed in a more conventional FCC unit. The first stage of processing uses a low activity, cheap contact material, which transfers heat to the feed and provides an abundance of surface area for deposition of metals and Conradson Carbon Residue (CCR). The first stage of processing is a relatively low severity thermal reaction, something like severe visbreaking (though no liquid phase is maintained ) or a mild fluid coking process. Although the low severity might seem beneficial, the conversions achieved in the first stage (thermal) are so low) and that low yields of iso-components are achieved.

A better approach, at least as far as maximizing the yield of gasoline from an FCC unit, was multi-stage processing of the feed. Several multi-stage processes are known which increase the quantity of gasoline produced, without seriously reducing the iso-component production of the unit.

One of the most interesting two stage catalytic cracking approach was developed by Shell, in the course of which they also developed riser cracking of fresh feed. The first stage was a moderate severity riser reactor, followed by a fractionator, followed by a conventional (at the time) dense bed cracking reactor. The first stage operated at a relatively short contact time, and at a relatively high temperature. This development in 1956 was ahead of its time, about a decade before the development and use of zeolite cracking catalyst. These developments were reported by Heldman, J. D., et al, Proc. API (III) Vol. 36, 1956, pp. 258–264.

This staged approach to maximize gasoline yields, was taken to an extreme degree by Mobil researchers Farber, Payne and Sailor who, in 1965, used multiple stages of cracking, over a moving bed (bead) zeolite containing catalyst, to get what might be considered the ultimate yields of gasoline in catalytic cracking. The cumulative advantage in gasoline yields for the low conversion per pass process, with intermediate gasoline removal, was 24% at 80% conversion. This work was published in FIG. 38 "Ultimate Yield in Cracking Over Zeolite, of Fluid Catalytic Cracking Report, p. 33, O & GJ Jan. 8, 1990, by Avidan et al.

Unfortunately, such multi-stage contacting causes lower light olefin yields. The iso to normal ratio of light olefins would be good, but the total yield of them declines drastically. The process converted more of the feed into gasoline boiling range materials, and would also make less light olefins. Such an approach would make more gasoline, but would require tremendous capital and operating expense for multi-stage cracking of FCC feed, and starve most alkylation units for light olefins needed to make alkylate. There would also be some yield loss, because each pass through an FCC reactor means some product is lost due to poor stripping.

We discovered that by using a two stage unit, with a profoundly different catalyst in the first stage we could break free of the constraints of current FCC units. With our two stage unit, we could greatly enhance the yield of desired iso-compounds, and minimize coke, light gas make and aromatics yields, while retaining the ability to process heavy feeds.

We realized that use of a shape selective first stage catalyst, preferably one with activity too high to permit its use in a conventional cracking unit, preferably at low severity conditions, provided the key to achieving the above objectives.

We preferred to send through the first stage unit a relatively light charge stock, even including such hydrocarbons as heavy naphthas, and avoid non-distillable materials. Thus we preferably use an unusually light feed, and an unusually shape selective, and preferably very active, catalyst in the first stage. Resid feeds, if any, are preferably sent only to the second stage which is a conventional FCC unit.

In contrast, the two stage resid cracking processes used a relatively inert first stage "catalyst". The Shell two-stage cracking process used a high temperature, short contact time riser cracking first stage, with a conventional cracking catalyst, processing all of the feed through both reactors. Our process uses a shape selective first stage catalyst in a two stage process to achieve some unusual results.

BRIEF SUMMARY OF THE INVENTION

Accordingly, the present invention provides a multi-stage process for the catalytic cracking of hydrocarbons to lighter products comprising: shape selectively cracking a hydrocarbon chargestock which is completely vaporizable in a shape selective cracking reactor operating at atmospheric to 100 psig and containing an inventory of shape selective catalyst having a Constraint Index of 1–12, at shape selective cracking conditions including a temperature sufficient to convert from 10 to 90 volume % of the feed to lower boiling components and produce selectively cracked products including iso-olefins and normally liquid products; separating said shape selectively cracked products into at least a lighter fraction and a heavier, normally liquid fraction; catalytically cracking, in the absence of added hydrogen a cat cracking chargestock comprising normally liquid hydrocarbons boiling above 650° F., wherein at least a portion of said cat cracking chargestock comprises said separated normally liquid products of shape selective cracking, in a catalytic cracking means operating at catalytic cracking conditions sufficient to convert at least a majority, by volume, of the cat cracking chargestock to lower boiling components and produce catalytically cracked products; and fractionating said catalytically cracked products to produce a gasoline boiling range liquid product, at least one fuel oil boiling range liquid product, and at least one product boiling below the gasoline boiling range.

In another embodiment, the present invention provides a multi-stage process for the catalytic cracking of a first chargestock having less than 10 wt % 1000° F.+ components selected from the group of a vacuum gas oil, a paraffinic resid and a naphthenic resid and mixtures thereof and a second chargestock having at least 10 wt % 1000° F.+ components to lighter products comprising: heating and completely vaporizing said first chargestock; shape selectively cracking, in the absence of added hydrogen, said vaporized first chargestock in a shape selective cracking reactor containing an inventory of shape selective cracking catalyst containing zeolites selected from the group of ZSM-5, ZSM-12, MCM-22, zeolite Beta and mixtures thereof, and operating at shape selective cracking conditions including a pressure of atmospheric to 100 psig, and a temperature and space velocity sufficient to convert from 10 to 90 volume % of said first chargestock to selectively cracked products including lower boiling iso-olefin components and normally liquid products boiling above 700° F.; cooling, condensing, and separating selectively cracked products to produce a normally liquid fraction boiling above 700° F. and at least one lighter fraction comprising selectively cracked products boiling below 700° F.; catalytically cracking, in a catalytic cracking reactor operating at catalytic cracking conditions, said second chargestock having at least 10 wt % 1000° F.+ components and at least a portion of said normally liquid fraction boiling above 700° F. from said shape selective cracking reactor, by contact with a source of hot regenerated FCC catalyst to produce catalytically cracked products and spent FCC catalyst; and fractionating, in an FCC main fractionator, said catalytically cracked products from said FCC reactor to produce a plurality of catalytically cracked product fractions including a gasoline boiling range fraction, a fuel oil fraction boiling above the gasoline range and a at least one fraction boiling below the gasoline range.

In a preferred embodiment, the present invention provides a process for the catalytic cracking of a first chargestock which is wholly distillable and a second chargestock having at least 10 wt % non-distillable components boiling above 1000° F. comprising: heating and completely vaporizing said first chargestock; shape selectively cracking, in the absence of added hydrogen, said vaporized first chargestock in a shape selective cracking reactor containing an inventory of shape selective cracking catalyst containing zeolites selected from the group of ZSM-5, ZSM-12, MCM-22, zeolite Beta and mixtures thereof, and operating at shape selective cracking conditions including a pressure of atmospheric to 100 psig, and a temperature and space velocity sufficient to convert from 10 to 90 volume % of said first chargestock to selectively cracked products; catalytically cracking, in a catalytic cracking reactor operating at catalytic cracking conditions, said second chargestock having at least 10 wt % 1000° F.+ components by contact with a source of hot regenerated FCC catalyst to produce catalytically cracked products and spent FCC catalyst; and fractionating, in an FCC main fractionator, said catalytically cracked products from said FCC reactor and said shape selectively cracked products from said shape selective cracking reactor to produce a plurality of product fractions including a gasoline boiling range fraction, a fuel oil fraction boiling above the gasoline range and at least one fraction boiling below the gasoline range.

BRIEF DESCRIPTION OF THE DRAWING

The FIGURE is a simplified schematic diagram of a process of the invention, using a preferred shape selective cracking reactor operating in series or in parallel with a conventional cracking reactor.

DETAILED DESCRIPTION

The process of the present invention can be better understood with reference to the FIGURE.

A relatively light feed, preferably essentially free of non-distillables, is charged via line 1 to a shape selective cracker (SSC) means 10. The SSC may include conventional feed preheating means, pumps, heat exchange means and similar equipment. The SSC reactor may be a fixed bed, fluidized or moving bed reactor. Fluidized beds, or swing fixed bed reactors, are preferred, with dilute phase riser reactors especially preferred.

The FIGURE shows use one type of preferred reactor, which uses hot regenerated cracking catalyst, added via line 110 to vessel 10, to supply the heat needed to drive the reaction. Hot regenerated FCC catalyst, typically 60–80 micron particles, are added to the base of the vessel, where they contact and heat the (preferably) preheated and totally vaporized feed, and optional steam or other light gas added via line 101. The feed passes up through grid floor 130 into a bubbling fluidized bed of conventional FCC catalyst and much larger particles of shape selective catalyst, preferably ZSM-5. The cracking catalyst will of course crack the incoming feed to some extent, but will rapidly coke up and deactivate. The cracking catalysts main function is to act as a heat carrier. The conventional cracking catalyst is withdrawn from vessel 10 via "bathtub" 115 and outlet 120 and charged back to the FCC unit for regeneration in the FCC regenerator. In the embodiment shown, there is no separate regenerator associated with the SSC reactor, enough large particles of ZSM-5 rich catalyst randomly enter bathtub 115 and pass through the FCC regenerator to permit the average ZSM-5 catalyst inventory in vessel 10 to remain at a satisfactorily high level. A bottom draw from the FCC regenerator (not shown in detail) is preferred so that large particles of ZSM-5 can quickly be withdrawn from the FCC regenerator and will not be trapped there.

The spectrum of cracked products produced by the SSC reactor is discharged via line 12, and may be charged directly to a fractionation means 20 via line 13. Fractionator 20 recovers normally gaseous products via line 22, highly olefinic, and rich in iso-compound fractions boiling below the naphtha range via line 24, naphtha fractions via line 28, and heavy fractions via line 28. The heavy fractions may be charged to mix with the heavy feed added to the FCC unit via line 31, and the mixture sent via line 32 to the FCC unit 30.

The fractionator 20 is optional, and in some units it will be preferred to send the entire effluent from the SSC 10 via line 14 to mix with the FCC feed via line 15, or charged to the FCC main column 40 via line 16. The SSC effluent may also be used as a quench stream in the FCC riser reactor. The optimum treatment and routing of the SSC effluent depends on local conditions.

When the feed to the SSC is very light relative to FCC feed, and/or when operating severity in the SSC is fairly high, it will be cheaper to simply let the SSC use the FCC main fractionator, and save on the cost of a separate product recovery section for the SSC. This is pure parallel operation of the SSC and the FCC. When the feed to the SSC is relatively heavy, and/or operating severity in the SSC is relatively low, it will usually be beneficial to process the heavy ends remaining after SSC in the FCC unit, to achieve additional conversion.

Usually it will be beneficial to keep at least the light SSC products out of the FCC reactor. To this end the fractionator 20 may be a simple flash pot, designed to achieve a limited separation of, e.g., LCO and lighter components from heavier hydrocarbons.

The FCC unit 30 is generally conventional, and preferably includes a riser reactor, not shown. The FCC unit processes conventional heavy feed from line 31, added via line 32, which may include some resid, and some or all of the SSC effluent added via lines 28 or 15, respectively. The FCC regenerator, not shown in detail, is adapted to permit withdrawal of a stream of hot regenerated catalyst via line 110 for transmission to the SSC vessel 10, and for return of FCC catalyst from SSC vessel 10, via catalyst return line 120.

Cracked products from the FCC unit are discharged via line 33, and may be mixed with SSC effluent, or a fraction of it, and added via line 16, and charged to the FCC main column 40. Light ends are removed via line 41, light olefinic hydrocarbons removed via line 42, FCC naphtha removed via line 43, and cycle oils removed via line 44. A heavy fraction, e.g., a slurry oil, may be removed via line 45, or recycled to the FCC unit by means not shown. The operation of the FCC unit 30 is generally conventional, but use of SSC effluent as quench is novel. Operation of the FCC main column is generally conventional, but use of this column to upgrade at least a fraction of the SSC effluent is novel.

Having given a brief overview of the process of the present invention, and a preferred SSC reactor, a more detailed description of individual components will now be presented.

FEEDS

Most FCC and TCC units crack gas oil or vacuum gas oil feeds, i.e., those having an initial boiling point above 400°-500° F., and an end boiling point above 750°-850° F.

The feed can include any wholly or partly non-distillable fraction, e.g. 1000° F.+ boiling range material. Resids, deasphalted resids, tar sands, shale oils, coal liquids and similar heavy material, may be used as part or all Of the feed. The first stage of catalytic cracking, especially when using the preferred high zeolite content, low cracking activity matrix, can tolerate heavy feeds fairly well. Although heavy ends and non-distillables can be tolerated, it will usually be preferred to operate with different boiling range feeds to each stage, and most preferably with feeds having different crackability.

The first stage or SSC feed (line 1) can be much lighter than the second stage or FCC feed (line 31), especially when operated in parallel. The first stage feed should be easier to crack than the second stage feed. Preferably the first stage feed contains more paraffins and/or naphthenes, particularly paraffinic feeds with relatively low amounts of branched chain paraffins, gas oil or very light vacuum gas oil, is an ideal feed stock, because it is readily vaporizable and easily crackable. Using these lighter feedstocks, the feed can be completely vaporized, and preheated to the desired reaction temperature.

In this case, the first stage feed is preferably totally vaporized, and substantially superheated, to reduce the need for heat input to this reactor.

The present process also tolerates very well charging of heavy feeds to the first, or SSC reactor, especially when a high silica, shape selective catalyst such as ZSM-5 is used as part or all of the zeolite content of the SSC catalyst. The high silica shape selective zeolites do not deactivate rapidly, and require infrequent regeneration, at low temperature, as compared to conventional cracking catalyst. The preferred high silica SSC catalysts are very resistant to metals in the feed, and can function as a very good metal trap upstream of the FCC. Thus the SSC reactor can serve simultaneously as a metals trap and as a selective cracking reactor, and in this mode of operation the feed can be very heavy, including large amounts of resid and or vacuum resid. When VGO and/or resid containing feeds are charged to the SSC, it will usually be beneficial to charge at least the 700° F.+ components of the SSC effluent to the FCC.

Shape Selective Cracking Catalyst

The first stage cracking catalyst, or "shape selective" catalyst, is preferably quite a bit different from conventional cracking catalysts. It must be far more shape selective than the catalysts now used in conventional FCC units. Preferably, the SSC catalyst contains large amounts of shape selective zeolites such as steam stabilized medium pore zeolites or other selective cracking catalysts Any zeolite having a constraint index of 1-12 can be used herein as the shape selective zeolite, but ZSM-5 is especially preferred. Details of the Constraint Index test procedures are provided in J. Catalysis 67, 218-222 (1981) and in U.S. Pat. No. 4,711,710 (Chen et al), both of which are incorporated herein by reference.

Preferred shape selective zeolites are exemplified by ZSM-5, ZSM-11, ZSM-12, ZSM-20, ZSM-23, ZSM-35, ZSM-48, ZSM-50, ZSM-57 and similar materials. ZSM-5, ZSM-12, zeolite Beta, and MCM-22 are especially preferred.

ZSM-5 is described in U.S. Pat. Nos. 3,702,886, 29,948 and in 4,061,724 (describing a high silica ZSM-5 as "silicalite").

ZSM-11 is described in U.S. Pat. No. 3,709,979.

ZSM-12 is described in U.S. Pat No. 3,832,449.

ZSM-23 is described in U.S. Pat. No. 4,076,842.

ZSM-35 is described in U.S. Pat. No. 4,016,245.

ZSM-57 is described in U.S. Pat. No. 4,046,859.

Zeolite Beta is described in U.S. Pat. No. 3,308,069.

Zeolites in which some other framework element is present in partial or total substitution of aluminum can be advantageous. Elements which can be substituted for part of all of the framework aluminum are boron, gallium, zirconium, titanium and trivalent metals which are heavier than aluminum. Specific examples of such catalysts include ZSM-5 and zeolite Beta containing boron, gallium, zirconium and/or titanium. In lieu of, or in addition to, being incorporated into the zeolite framework, these and other catalytically active elements can also be deposited upon the zeolite by any suitable procedure, e.g., impregnation.

Preferably, relatively high silica shape selective zeolites are used, i.e., with a silica/alumina ratio above 20/1, and more preferably with a ratio of 70/1, 100/1, 500/1 or even higher. High silica shape selective zeolites are not as active initially as those with more alumina, but the high silica zeolites retain their activity for a longer time, and are more selective, i.e., make less coke.

Preferably the shape selective zeolite content of the catalyst is relatively high, and preferably is the predominant factor in terms of conversion in the SSC reactor. Shape selective zeolite contents greater than 10% are preferred, with operation with 30 to 50 wt % shape selective being preferred, to maximize the desired shape selective conversion reactions.

LARGE PORE ZEOLITE

The SSC catalyst may contain some conventional large pore sieves, such as zeolite L, zeolite X, zeolite Y, and preferably higher silica forms of zeolite Y such as Dealuminized Y (DAY Y; U.S. Pat. No. 3,442,795); Ultrastable Y (USY; U.S. Pat. No. 3,449,070), Ultrahydrophobic Y (UHP-Y U.S. Pat. No. 4,331,694; U.S. Pat. No. 4,401,556). These materials may be subjected to conventional treatments, such as impregnation or ion exchange with rare earths to increase stability. REY is especially preferred as a large pore cracking component.

MATRIX

The matrix used in the SSC catalyst can be conventional. The function of the matrix in catalytic cracking catalyst is well known. Briefly stated, it protects the relatively soft and fragile molecular sieve components from physical damage. The matrix acts to some extent as a sodium and metals sink, and minimizes localized high temperatures when burning coke from the molecular sieve. Heat will not usually be a significant problem in the SSC cracker. Preferably the SSC cracking catalyst has a relatively low cracking activity, and does not form much coke. The matrix preferably plays only a minor role in the finished catalyst, and typically will be less than 70 wt % of the catalyst.

SSC Catalyst Size

Preferably the SSC catalyst is separable by physical means from the FCC catalyst, which permits its use in the preferred embodiment shown in the FIGURE. Such use of fast settling ZSM-5 is not, per se, novel. Extensive teaching on how to make and use ZSM-5 additives separable by elutriation from FCC catalyst is included in U.S. Pat. No. 4,988,653, Herbst, Owen & Schipper, which is incorporated herein by reference.

For use in the embodiment shown in the FIGURE, the SSC catalyst is preferably present as particles having an average particle diameter of at least about 200 microns, and most preferably at least about 500 microns.

SSC REACTOR

The SSC reactor may be a fixed bed, moving bed or fluidized bed. Swing fixed bed reactors, or the fluidized bed reactor shown in the Figure may be used. Preferably a riser reactor, preferably a recirculating riser reactor, is used.

The feeds to the SSC reactor can be relatively clean. The preferred catalysts, such as ZSM-5 in a low coke forming matrix, do not deactivate like conventional FCC catalysts, so it will be possible to run the unit with infrequent regeneration, or with continuous addition of fresh or regenerated catalyst and continuous withdrawal of spent catalyst. A separate, and usually quite small, SSC catalyst regenerator, not shown, may also be used if desired. The SSC catalyst regenerator can operate at relatively mild conditions, e.g., a temperature ranging from 950°–1350° F., preferably at 1000°–1050° F.

SSC REACTIONS

The SSC reactor preferably operates at conditions similar to those of FCC units, i.e., relatively low pressure, although at a somewhat lower temperature. Pressures ranging from atmospheric to 100 psig may be used in the SSC reactor, but preferably are 10 to 50 psig, and most preferably 15 to 30 psig.

Temperatures should be adjusted as needed to achieve the desired conversion. In many instances, it will be beneficial to limit conversion to less than 50 volume % boiling at a TBP of 430° F. Lower conversions maximize light olefin selectivity.

FCC

The FCC catalyst and hardware may be conventional, and are readily available commercially.

It will frequently be beneficial to operate the FCC reactor at somewhat higher severity than conventional FCC units since the feed crackability is more difficult in this case.

The FCC unit may be modified to permit circulation of catalyst from the base of the FCC regenerator to the SSC reactor, when heat from the FCC regenerator is used to drive the SSC reactor.

Low Efficiency Fractionation

In a preferred embodiment, maximum use is made of existing FCC hardware, while maximizing production of light iso-components. In this design, the effluent from the SSC reactor is charged to a fractionator with only two, or at most three, product withdrawal lines.

Thus the entire effluent from the SSC reactor may be charged to a relatively low efficiency fractionator 20, having only overhead and bottom draws. The overhead stream may be fed directly to the FCC main column 40, preferably to an intermediate elevation thereof above the point of addition of FCC vapor thereto. The SSC light ends can be fractionated into the desired product fractions, using only the hardware associated with the main fractionator. The SSC liquid fractions, preferably a 650° F. or 700° F.+ liquid, can be charged to the FCC unit.

Efficient fractionation is not needed, and only a few trays, or relatively short length of packing material is needed to affect a rough cut separation between SSC light and heavy components.

In an extreme case a simple vapor liquid separator may be used in place of fractionator 20, with the separator vapor stream fed to FCC main fractionator 40, and the separator liquid charged to the FCC reactor. The FCC main fractionator can be relied on to produce product streams having the requisite purity, eliminating the cost and expense of an SSC product fractionator. Some valuable SSC product will be sent through the FCC and somewhat overcracked, and some material which could beneficially be subjected to further upgrading in the FCC will bypass the FCC reactor, but the consequences are not serious.

We claim:

1. A multi-stage process for the catalytic cracking of hydrocarbons to lighter products comprising:

shape selectively cracking a hydrocarbon chargestock which is completely vaporizable in a first reactor, a shape selective cracking reactor operating at atmospheric to 100 psig and containing an inventory of shape selective catalyst having a constraint Index of 1–12, at shape selective cracking conditions including a temperature sufficient to convert less than 50 volume % of the feed to lower boiling components and produce selectively cracked products including iso-olefins and normally liquid products;

separating said shape selectively cracked products into at least a lighter fraction and a heavier, liquid fraction comprising 650° F.+ hydrocarbons;

charging at least a portion of said selectively cracked liquid fraction comprising 650° F.+ hydrocarbons to a catalytic cracking reactor;

catalytically cracking, in the absence of added hydrogen a cat cracking chargestock comprising a fresh feed comprising normally liquid hydrocarbons boiling above 650° F. and said portion of selectively cracked liquid in a second reactor, a catalytic cracking means operating at catalytic cracking conditions including a reactor temperature of 425°–600° C. and sufficient to convert at least a majority, by volume, of the cat cracking chargestock to lower boiling components and produce catalytically cracked products; and fractionating said catalytically cracked products to produce a gasoline boiling range liquid product, at least one fuel oil boiling range liquid product, and at least one product boiling below the gasoline boiling range.

2. The process of claim 1 wherein the hydrocarbon chargestock to said shape selective cracking reactor is a gas oil, a vacuum gas oil, a paraffinic resid, a naphthenic resid or mixtures thereof.

3. The process of claim 1 wherein the hydrocarbon chargestock to said shape selective cracking reactor is essentially free of hydrocarbons boiling above 1000° F.+ and the hydrocarbon chargestock to the catalytic cracking reactor comprises at least 10 wt % 1000° F.+ material.

4. The process of claim 1 wherein the cracked products from the shape selective cracking reactor are separated to produce at least one light product fraction boiling below 700° F. and at least one liquid product boiling above 700° F., and said light product fraction is charged to and fractionated in said catalytic cracking fractionator and said liquid product boiling above 700° F. is mixed with the feed to said catalytic cracking reactor.

5. The process of claim 1 wherein the shape selective cracking catalyst contains at least 30 wt % zeolites having a Constraint Index (CI) of 1–12.

6. The process of claim 1 wherein the shape selective cracking catalyst contains at least 30 wt % of a zeolite is selected from the group of ZSM-5, ZSM-12, MCM-22, zeolite Beta and mixtures thereof.

7. The process of claim 1 wherein the shape selective cracking catalyst consists of zeolites in a matrix, and the matrix is at least 95 wt % silica.

8. The process of claim 1 wherein the shape selective cracking reactor is a riser reactor.

9. A multi-stage process for the catalytic cracking of a first chargestock having less than 10 wt % 1000° F.+ components selected from the group of a vacuum gas oil, a paraffinic distillate and a naphthenic distillate and mixtures thereof and a second chargestock having at least 10 wt % 1000° F.+ components to lighter products comprising:

heating and completely vaporizing said first chargestock;

shape selectively cracking, in a first reactor in the absence of added hydrogen, said vaporized first chargestock in a shape selective cracking reactor containing an inventory of shape selective cracking catalyst containing zeolites selected from the group of ZSM-5, ZSM-12, MCM-22, zeolite Beta and mixtures thereof, and operating at shape selective cracking conditions including a pressure of atmospheric to 100 psig, and a temperature and space velocity sufficient to convert less than 50 volume % of said first chargestock to selectively cracked products including lower boiling iso-olefin components and normally liquid products boiling above 700° F.;

cooling, condensing, and separating selectively cracked products to produce at least one normally liquid fraction comprising 650° F.+ hydrocarbons and at least one lighter fraction comprising selectively cracked products boiling below 650° F.;

catalytically cracking, in a second reactor, a catalytic cracking reactor operating at catalytic cracking conditions including a reactor temperature of 425°–600° C. and, said second chargestock having at least 10 wt % 1000° F.+ components and at least a portion of said normally liquid fraction boiling above 650° F. from said shape selective cracking reactor, by contact with a source of hot regenerated FCC catalyst to produce catalytically cracked products and spent FCC catalyst; and fractionating, in an FCC main fractionator, said catalytically cracked products from said FCC reactor to produce a plurality of catalytically cracked product fractions including a gasoline boiling range fraction, a fuel oil fraction boiling above the gasoline range and at least one fraction boiling below the gasoline range.

10. The process of claim 9 wherein said at least one lighter fraction comprising selectively cracked products boiling below 700° F.+ from the shape selective cracking reactor is charged to said FCC main fractionator.

11. The process of claim 9 wherein the FCC catalyst is regenerated in a catalyst regenerator operating at catalyst regeneration conditions including a temperature of 1100° to 1500° F. and said shape selective cracking catalyst is regenerated in a catalyst regenerator operating at catalyst regeneration conditions including a temperature of 950 to 1350° F. and at least 100° F. below the temperature in said FCC catalyst regenerator.

12. The process of claim 9 wherein said selectively cracked products are cooled, condensed, and separated to produce a normally liquid fraction boiling above 400° F. and at least one lighter fraction comprising selectively cracked products boiling below 400° F.; and said liquid product boiling above 400° F. is mixed with the feed to the catalytic cracking reactor, and said selectively cracked product boiling below 400° F. is charged to said FCC main fractionator.

13. A process for the catalytic cracking of a first chargestock which is wholly distillable and a second chargestock having at least 10 wt % non-distillable components boiling above 1000° F. comprising:

heating said first chargestock;

shape selectively cracking in a first reactor, in the absence of added hydrogen, said first chargestock in a shape selective cracking reactor containing an inventory of shape selective cracking catalyst containing zeolites selected from the group of ZSM-5, ZSM-12, MCM-22, zeolite Beta and mixtures thereof, and operating at shape selective cracking conditions including a temperature and space velocity sufficient to convert from less than 50 volume % of said first chargestock to selectively cracked products;

fractionating, in a fractionator having no more than three product withdrawal lines, said selectively cracked products to produce at least a selectively cracked liquid fraction comprising 650° F.+ liquid and a selectively cracked vapor fraction;

charging to a catalytic cracking reactor said selectively cracked liquid fraction;

catalytically cracking, in said catalytic cracking reactor operating at catalytic cracking conditions including a reactor temperature of 425°–600° C. and, said second chargestock having at least 10 wt % 1000° F.+ components and said selectively cracked liquid fraction by contact with a source of hot regenerated FCC catalyst to produce catalytically cracked products and spent FCC catalyst;

fractionating, in an FCC main fractionator, said catalytically cracked products from said FCC reactor to produce a plurality of product fractions including a gasoline boiling range fraction, a fuel oil fraction boiling above the gasoline range and at least one fraction boiling below the gasoline range; and charging said selectively cracked vapor fraction to said FCC main fractionator.

14. The process of claim 13 wherein said selectively cracked vapor is added to said FCC main fractionator at an elevation above the point of addition of catalytically cracked products from said FCC reactor.

15. The process of claim 13 wherein said selectively cracked products are fractionated in a vapor liquid separator having a vapor line connective with said FCC main column and a liquid line connective with said FCC reactor.

* * * * *